US007416429B1

(12) United States Patent
Hung

(10) Patent No.: US 7,416,429 B1
(45) Date of Patent: Aug. 26, 2008

(54) MEMORY CARD CONNECTOR

(75) Inventor: Pei-Chiao Hung, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/944,842

(22) Filed: Nov. 26, 2007

(51) Int. Cl.
*H01R 29/00* (2006.01)

(52) U.S. Cl. ..... 439/188; 439/159; 439/630

(58) Field of Classification Search ..... 439/630, 439/188, 159, 941, 677
See application file for complete search history.

(56) References Cited

U.S. PATENT DOCUMENTS 6,394,827 B2 * 5/2002 Nogami ..... 439/159
6,805,566 B2 * 10/2004 Chia-Chen ..... 439/188
7,128,613 B1 * 10/2006 Lee et al. ..... 439/630
2008/0090437 A1 * 4/2008 Huang et al. ..... 439/188

* cited by examiner

*Primary Examiner*—Michael C Zarroli
(74) *Attorney, Agent, or Firm*—WPAT, P.C.; Anthony King

(57) ABSTRACT

A memory card connector includes an insulating housing defining conductive terminal grooves and two locating grooves at a sidewall thereof. A shelter shell coupling with the insulating housing to form a card cavity has a top section and two side sections. A front surface of the top section extends frontward and then extends downward to form two anti-mismating portions adjacent to the two side sections. The two anti-mismating portions have different width and vertical length. Conductive terminals are fixed in the conductive terminal grooves and soldered to a printed circuit board for electrically engaging with corresponding contacts of a memory card inserted into the card cavity. And a pair of switch terminals mounted in the locating grooves and soldered to the printed circuit board. One switch terminal is pressed outward by the memory card fully inserted into the card cavity, which causes the two switch terminals to contact with each other for grounding.

5 Claims, 4 Drawing Sheets

MEMORY CARD CONNECTOR

BACKGROUND OF THE INVENTION

1. Field of the Invention

The present invention generally relates to a memory card connector, and more particularly to a memory card connector having anti-mismating portions to prevent incorrect insertion of a memory card.

2. The Related Art

Recently, electronic devices, such as digital cameras, MP3 players, cellular phones, etc., are required with larger capacity of storage to store data. A memory card, such as a Memory Stick Duo card, a SD card, a Mini SD card, a MMC card, a M2 card, etc., which has larger capacity of storage and a small size, is extensively used to expend the capacity of storage of the electronic devices. The data transmission between the electronic device and the memory card is through a memory card connector mounted on a PCB (printed circuit board) of the electronic device for connecting with the memory card. The memory card connector has an insulating housing. The insulating housing includes a receiving cavity for receiving the memory card and a plurality of grooves for respectively receiving a plurality of terminals. One end of the terminal forms a soldering portion for being soldered to the PCB, and the other end of each terminal forms a connecting portion for mating with the memory card. A metallic cover couples with the insulating housing. The memory card is inserted and held in the receiving cavity of the memory card connector for being used in storing various data and taken by the electronic device as a recording medium. If not in use, the inserted memory card can be pulled out from the receiving cavity of the memory card connector.

However, the memory card connector described above has no structure to prevent incorrect insertion therein of the memory card. Once the memory card is inserted into the memory card connector in a wrong way, the terminals of the memory card connector are crushed and broken. Therefore, the connection between the memory card and the memory card connector is susceptible to being interrupted, resulting in unstable signal transmission between the memory card and the memory card connector.

SUMMARY OF THE INVENTION

Accordingly, an object of the present invention is to provide a memory card connector having anti-mismating portions to prevent incorrect insertion of a memory card. The memory card connector includes an insulating housing having a front wall, a rear wall, two sidewalls, a bottom wall and a top wall. The insulating housing defines conductive terminal grooves and two locating grooves at a sidewall thereof. A shelter shell coupling with the insulating housing to form a card cavity therebetween has a top section and two side sections extending downward from both sides of the top section respectively. A front surface of the top section extends frontward and then extends downward to form the two anti-mismating portions adjacent to the two side sections respectively. The two anti-mismating portions have different width and vertical length for mating with the memory card having a stepped side and inserted into the card cavity. One anti-mismating portion that is shorter is placed on the stepped side and the other anti-mismating portion is against the other side opposite to the stepped side of the memory card for ensuring correct insertion of the memory card. Conductive terminals are fixed in the conductive terminal grooves of the insulating housing and soldered to a printed circuit board respectively for electrically engaging with corresponding contacts of the memory card. And a pair of switch terminals are mounted in the locating grooves of the insulating housing respectively and soldered to the printed circuit board. One switch terminal is pressed outward by the memory card fully inserted into the card cavity, which causes the two switch terminals to contact with each other for grounding.

As described above, the anti-mismating portions are designed in accordance with the industry standard of the memory card, which ensures that the memory card is inserted into the card cavity in a correct way. The memory card connector has a simple structure and is easy to be assembled and manufactured. In addition, whether the two switch terminals electrically contact with each other or not indicates that the memory card is fully inserted into the memory card connector or not, ensuring the signal transmission between the memory card and the memory card connector to be stable.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
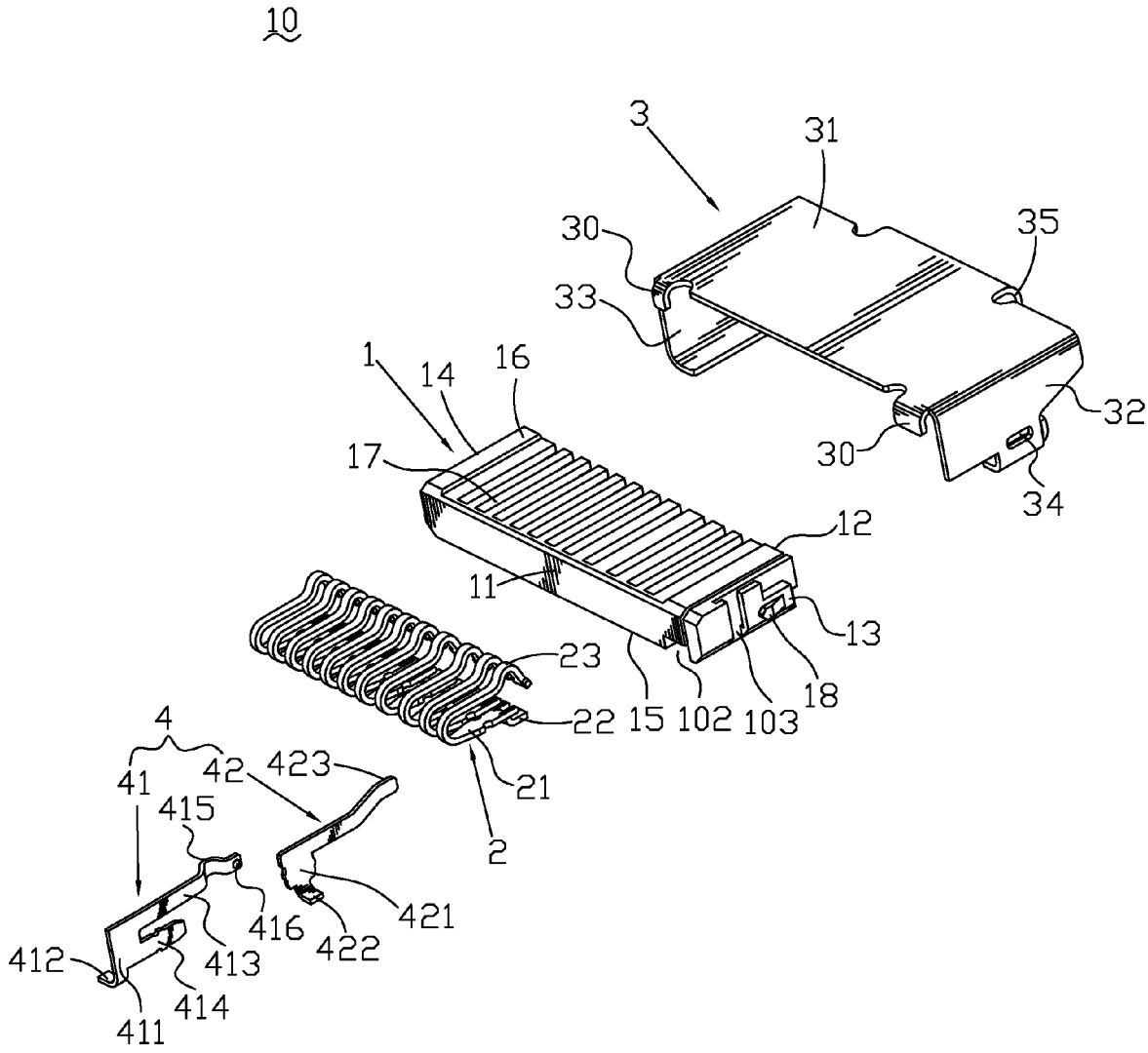
FIG. 1 is an exploded view of a memory card connector of the present invention.
Figure 2:
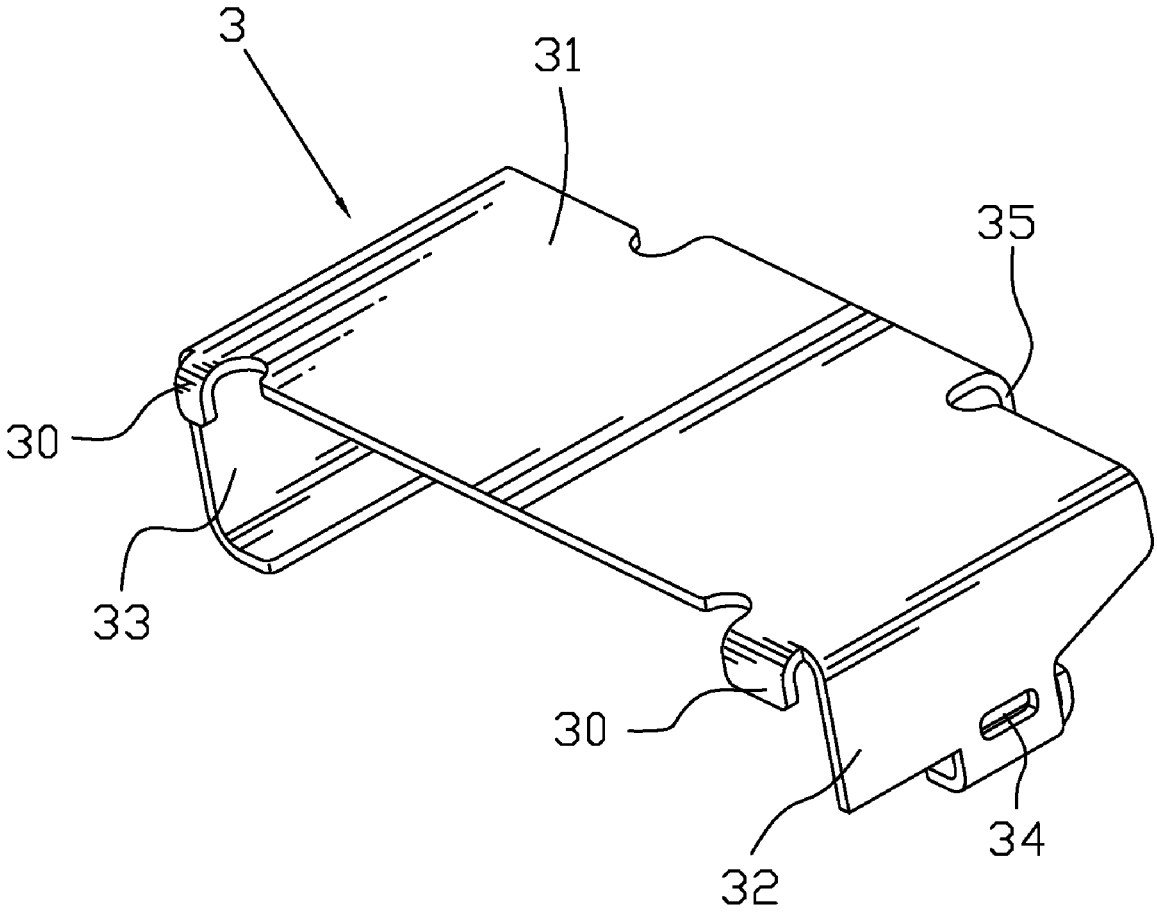
FIG. 2 is a perspective view of a shelter shell of the memory card connector.
Figure 4:
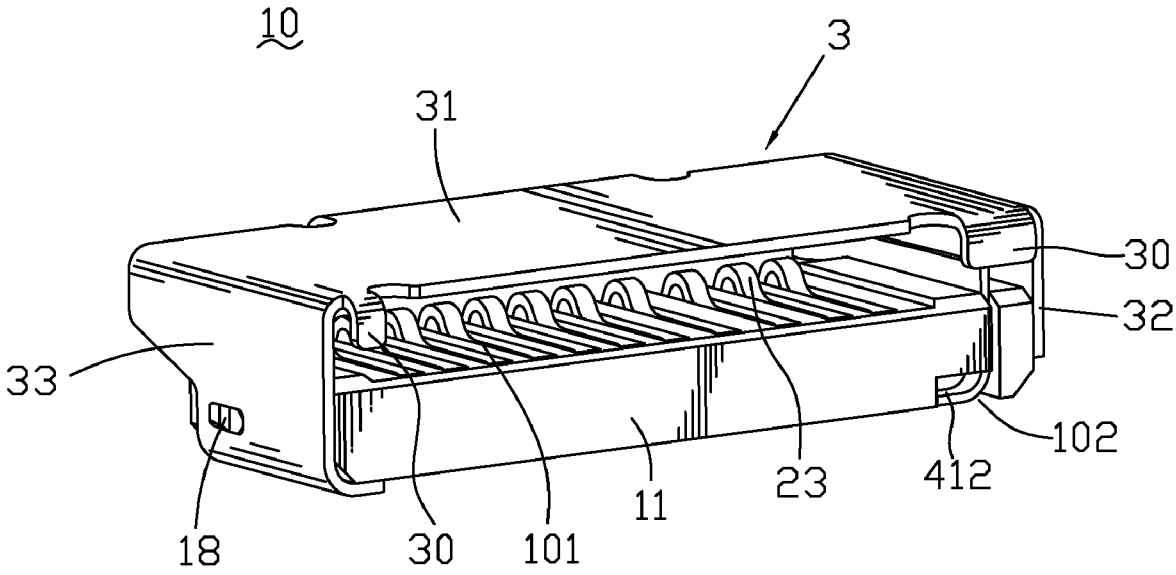
FIG. 4 is another perspective view of the memory card connector.

Referring to FIG. 1 and FIG. 4, a memory card connector 10 mountable on a printed circuit board (not shown) and electrically connecting with a memory card (shown in FIG. 5) includes an insulating housing 1, a plurality of conductive terminals 2 received in the insulating housing 1 respectively, a shelter shell 3 coupling with the insulating housing 1 to form a card cavity 101 therebetween for receiving the memory card therein, and a pair of switch terminals 4 received in the insulating housing 1. In a preferred embodiment of the present invention, the memory card is a Memory Stick Micro Card 20 which will be called M2 card for short in the following description.

Please refer to FIG. 1. The insulating housing 1 is substantially rectangular and disposed transversely. The insulating housing 1 has a front wall 11, a rear wall 12, a first sidewall 13, a second sidewall 14, a bottom wall 15 and a top wall 16. The insulating housing 1 longitudinally defines a plurality of conductive terminal grooves 17 in a side-by-side row and passing through the top wall 16, the bottom wall 15 and the rear wall 12. The two sidewalls 13, 14 protrude outward to form a locking bump 18 thereon. A first locating groove 102 and a second locating groove 103 are longitudinally defined in the first sidewall 13. Therein, the first locating groove 102 passes through the corresponding front wall 11, the top wall 16 and the front of the bottom wall 15. The second locating groove 103 is adjacent to the first locating groove 102 and defined vertically in the outer side of the first sidewall 13.

The conductive terminal 2 has a base portion 21 fixed in the conductive terminal groove 17. A rear end of the base portion 21 protrudes downward to form a soldering portion 22 parallel with a bottom surface of the bottom wall 15 for being soldered to the printed circuit board. The other end of the base portion 21 extends frontward and then extends backward to form a contacting portion 23. The contacting portion 23 tilts upward a bit and is raised into the card cavity 101 for engaging with a corresponding contact of the M2 card 20 inserted into the card cavity 101.

Figure 3:
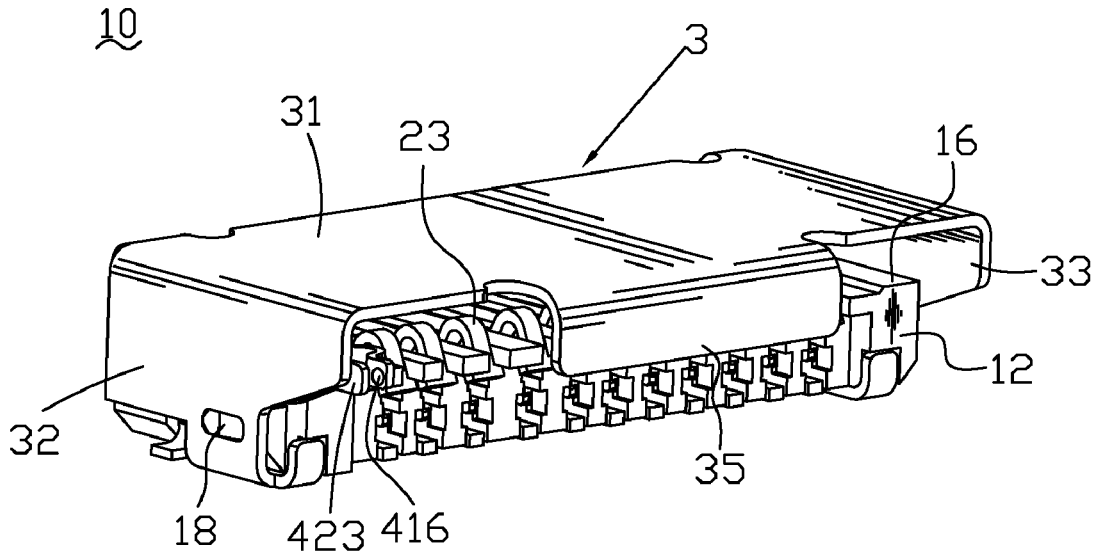
FIG. 3 is a perspective view of the memory card connector.

Please refer to FIG. 1, FIG. 3 and FIG. 4. The switch terminals 4 are sheet-shaped and include a movable terminal 41 and an immovable terminal 42. The movable terminal 41 mounted in the first locating groove 102 of the insulating housing 1 has a main body 411. A bottom surface of the main body 411 extends toward one side thereof to form a second soldering portion 412 soldered to the printed circuit board. A substantial middle of a rear surface of the main body 411 extends rearward to define a locating arm 414 fixedly disposed in the first locating groove 102. A top surface of the main body 411 extends rearward to form a resilient arm 413 above and parallel with the locating arm 414. The resilient arm 413 is raised above the top wall 16 of the insulating housing 1 and received in the card cavity 101. A rear end of the resilient arm 413 protrudes to form a vaulted pressing portion 415 facing the inner of the card cavity 101 for being pressed outward by the M2 card 20 fully inserted into the card cavity 101. A substantially rounded contacting projection 416 is defined on the rear end of the resilient arm 413, which is adjacent to and behind the pressing portion 415. The immovable terminal 42 fixedly mounted in the second locating groove 103 of the insulating housing 1 has a basic body 421. A bottom surface of the basic body 421 extends toward one side thereof to form a third soldering portion 422 soldered to the printed circuit board. A top surface of the basic body 421 extends rearward to form a touching portion 423 at rear end which inclines to the inner of the card cavity 101 a bit. The touching portion 423 has a distance from the contacting projection 416 of the movable terminal 41 without the M2 card 20 fully inserted into the card cavity 101.

With reference to FIGS. 1-4, the shelter shell 3 has a top section 31 disposed above the top wall 16 of the insulating housing 1. Two side sections 32, 33 extend downward from both sides of the top section 31 respectively. The two side sections 32, 33 define a locating hole 34 receiving the locking bump 18 therein for fixedly assembling the shelter shell 3 with the insulating housing 1. A front surface of the top section 31 extends frontward and then extends downward to form two anti-mismating portions 30 adjacent to the two side sections 32, 33 respectively. The two anti-mismating portions 30 have different width and vertical length. Because of the industry standard of the M2 card 20, the M2 card 20 has a stepped side thereof. When the M2 card 20 is inserted in the card cavity 101 in a correct way, the M2 card 20 is located between the two anti-mismating portions 30. The anti-mismating portion 30 that is shorter is placed on the stepped side of the M2 card 20 and the other anti-mismating portion 30 is against the other side opposite to the stepped side of the M2 card 20 for preventing incorrect insertion of the M2 card 20. The middle of a rear surface of the top section 31 extends downward to define a preventing section 35 for avoiding the M2 card 20 inserted overly.

Figure 5:
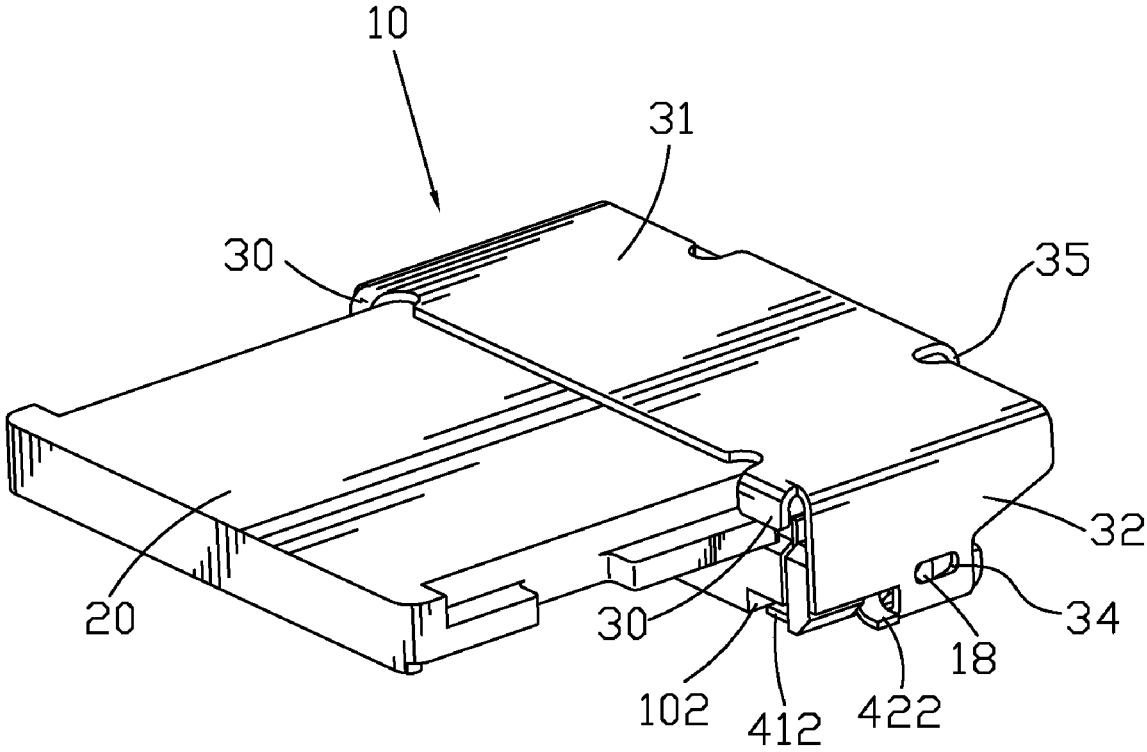
FIG. 5 is a perspective view of the memory card connector receiving a memory card therein.

Please refer to FIG. 5 together with FIG. 3 and FIG. 4. The contacting projection 416 of the movable terminal 41 and the touching portion 423 of the immovable terminal 42 keep a distance from each other before the M2 card 20 is inserted in the card cavity 101. While the M2 card 20 is partially inserted in the card cavity 101 in the correct way, the contacts of the M2 card 20 respectively engage with the contacting portions 23 of the conductive terminals 2 firstly. Then the M2 card 20 is inserted rearward continually. After the M2 card 20 is fully inserted into the card cavity 101, the stepped side of the M2 card 20 compresses the pressing portion 415 of the movable terminal 41 to cause the contacting projection 416 to move toward the touching portion 423 of the immovable terminal 42 and electrically contact the touching portion 423 for grounding. Therefore, a circuit disposed on the printed circuit board detects that the contacting projection 416 electrically contacts to the touching portion 423 for grounding, and then drives the M2 card 20 beginning storing or reading data.

When the M2 card 20 is inserted in the card cavity 101 in an incorrect way, because of the industry standard of the M2 card 20, the M2 card 20 has a special structure and special dimensions, and therefore the anti-mismating portions 30 prevent the M2 card 20 from being inserted into the card cavity 101, which avoids the conductive terminals 2 being broken by the M2 card 20 incorrectly inserted into the card cavity 101.

As described above, the anti-mismating portions 30 are designed in accordance with the industry standard of the memory card, which ensures that the memory card is inserted into the card cavity 101 in the correct way. The memory card connector 10 has a simple structure and is easy to be assembled and manufactured. In addition, whether the contacting projection 416 of the movable terminal 41 electrically contacts the touching portion 423 of the immovable terminal 42 or not indicates that the M2 card 20 is fully inserted into the memory card connector 10 or not, ensuring the signal transmission between the M2 card 20 and the memory card connector 10 to be stable.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A memory card connector, comprising:

an insulating housing, having a front wall, a rear wall, two sidewalls, a bottom wall and a top wall, the insulating housing defining conductive terminal grooves and two locating grooves at a sidewall thereof;

a shelter shell, coupling with the insulating housing to form a card cavity therebetween, the shelter shell having a top section and two side sections extending downward from both sides of the top section respectively, a front surface of the top section extending frontward and then extending downward to form two anti-mismating portions adjacent to the two side sections respectively, the two anti-mismating portions having different width and vertical length for mating with a memory card having a stepped side and inserted into the card cavity, one anti-mismating portion which is shorter placed on the stepped side and the other anti-mismating portion being against the other side opposite to the stepped side of the memory card for ensuring correct insertion of the memory card;

conductive terminals, fixed in the conductive terminal grooves of the insulating housing and soldered to a printed circuit board respectively for electrically engaging with corresponding contacts of the memory card; and a pair of switch terminals, mounted in the locating grooves of the insulating housing respectively and soldered to the printed circuit board, one switch terminal pressed outward by the memory card fully inserted into the card cavity, which causes the two switch terminals to contact with each other for grounding.

2. The memory card connector as claimed in claim 1, wherein one of the locating grooves passes through the corresponding front wall, the top wall and the front of the bottom wall, the other locating groove is adjacent to the mentioned locating groove and defined vertically in the outer side of the sidewall.

3. The memory card connector as claimed in claim 2, wherein the switch terminals are sheet-shaped and include a movable terminal and an immovable terminal, the movable terminal has a main body, a bottom surface of the main body extends toward one side thereof to form a second soldering portion soldered to the printed circuit board, a top surface of the main body extends rearward to form a resilient arm raised above the top wall of the insulating housing and received in the card cavity, a rear end of the resilient arm protrudes to form a pressing portion facing the inner of the card cavity for being pressed outward by the memory card fully inserted into the card cavity, a contacting projection is defined on the rear end of the resilient arm, the immovable terminal has a basic body, a bottom surface of the basic body extends toward one side thereof to form a third soldering portion soldered to the printed circuit board, a top surface of the basic body extends rearward to form a touching portion at rear end which inclines to the inner of the card cavity a bit and faces the contacting projection of the movable terminal.

4. The memory card connector as claimed in claim 1, wherein the two sidewalls of the insulating housing respectively protrude outward to form a locking bump, the two side sections of the shelter shell define a locating hole receiving the locking bump for fixedly assembling the shelter shell with the insulating housing.

5. The memory card connector as claimed in claim 1, wherein the top section of the shelter shell extends downward from the middle of a rear surface thereof to define a preventing section for avoiding the memory card inserted overly.

* * * * *